US008200115B2

(12) United States Patent
Hwang et al.

(10) Patent No.: US 8,200,115 B2
(45) Date of Patent: Jun. 12, 2012

(54) IMAGE FORMING APPARATUS WITH EXTERNAL AIR CIRCULATION CHAMBER

(75) Inventors: Gyu Deok Hwang, Seoul (KR); Sung Hyuo Kim, Suwon-si (KR); Sun Soo Kim, Suwon-si (KR); Jong Woo Kim, Yongin-si (KR); Sung Ku Baek, Suwon-si (KR); Hyun Ki Cho, Hanam-si (KR); Je Hyoung Ryu, Seongnam-si (KR); Tae Hee Kim, Incheon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 433 days.

(21) Appl. No.: 12/081,951

(22) Filed: Apr. 23, 2008

(65) Prior Publication Data

US 2008/0304855 A1 Dec. 11, 2008

(30) Foreign Application Priority Data

Jun. 11, 2007 (KR) ..... 10-2007-0056969

(51) Int. Cl.
*G03G 21/20* (2006.01)

(52) U.S. Cl. ..... 399/92

(58) Field of Classification Search ..... 399/67, 399/69, 92, 94

See application file for complete search history.

(56) References Cited

U.S. PATENT DOCUMENTS

| | | | | |
|---|---|---|---|---|
| 2005/0008389 | A1 | 1/2005 | Kim et al. | |
| 2006/0018679 | A1 * | 1/2006 | Ishino et al. | 399/94 |
| 2006/0269314 | A1 * | 11/2006 | Lee et al. | 399/92 |
| 2007/0019981 | A1 * | 1/2007 | Kawamata | 399/92 |

FOREIGN PATENT DOCUMENTS

| | | | |
|---|---|---|---|
| CN | 1725119 | A | 1/2006 |
| JP | 2000293089 | A * | 10/2000 |
| JP | 2006-030790 | | 2/2006 |
| KR | 10-2004-0059713 | | 7/2004 |
| KR | 10-2006-0121339 | | 11/2006 |

OTHER PUBLICATIONS

Chinese Office Action for corresponding Chinese Application 200810095326.1; issued Apr. 14, 2010.
Korean Office Action for related application 10-2007-0056969.

* cited by examiner

*Primary Examiner* — David Gray
*Assistant Examiner* — Billy J Lactaoen
(74) *Attorney, Agent, or Firm* — Staas & Halsey LLP

(57) ABSTRACT

An image forming apparatus capable of minimizing a temperature rise of a cover is disclosed. The image forming apparatus includes a main body, a fusing unit mounted in the main body to fuse an image to paper, a cover mounted to the main body to expose the fusing unit, a heat shielding member mounted proximate to an inner side of the cover to block heat transferred from the fusing unit, an external air circulation chamber formed between the heat shielding member and the cover, in which external air circulates by convection, and at least one external air flow hole, through which the air flows into/out of the external air circulation chamber.

9 Claims, 4 Drawing Sheets

IMAGE FORMING APPARATUS WITH EXTERNAL AIR CIRCULATION CHAMBER

CROSS-REFERENCE TO RELATED APPLICATIONS

This application claims the benefit of Korean Patent Application No. 2007-0056969, filed on Jun. 11, 2007 in the Korean Intellectual Property Office, the disclosure of which is incorporated herein by reference.

BACKGROUND

1. Field

The present invention relates to an image forming apparatus, and more particularly to an image forming apparatus which can minimize heat transfer from a fusing unit to an upper cover.

2. Description of the Related Art

An electrophotographic-type image forming apparatus, such as a laser printer, a copying machine, a fax machine, etc., includes an image forming unit which develops an electrostatic latent image on a photosensitive body by using a developer and transfers the image onto paper, and a fusing unit which fuses the transferred image to the paper by using heat and pressure. The paper supplied from a paper supply unit in a main body passes by the image forming unit and the fusing unit in order through a feeding path, and then is discharged to a paper discharge part.

Typically, the fusing unit is kept at a high temperature in order to increase a printing speed by rapidly fusing the transferred image to the paper. However, because heat of the fusing unit is transferred toward a cover provided on an upper portion of the main body, when a user touches the cover, heat may be transferred to the user. The user often opens the cover to remove the paper jammed in the main body or inspect the apparatus. However, the hot cover gives inconvenience in use to the user.

To solve this problem, Korean Patent Registration No. 10-463273 discloses an image forming apparatus which has a heat shielding member provided between a fusing unit and a cover to decrease the heat transfer from the fusing unit to the cover. However, the disclosed image forming apparatus has a limitation in decreasing a temperature of the cover because the air does not circulate smoothly around the heat shielding member and heat stays around the heat shielding member.

SUMMARY

Therefore, it is an aspect of the embodiment to provide an image forming apparatus that is capable of minimizing a temperature rise of a cover.

Additional aspects and/or advantages will be set forth in part in the description which follows and, in part, will be obvious from the description, or may be learned by practice of the invention.

The foregoing and/or other aspects are achieved by providing an image forming apparatus, including: a main body having a paper discharge part to discharge paper; a fusing unit mounted in the main body to fuse an image to the paper; a cover mounted to the main body to expose the fusing unit; a heat shielding member mounted proximate to an inner side of the cover to block heat transferred from the fusing unit; an external air circulation chamber formed between the heat shielding member and the cover, in which external air circulates by convection; and at least one external air flow hole, through which the air flows into/out of the external air circulation chamber.

The cover may be mounted on an upper portion of the main body to expose or shield the fusing unit, and the heat shielding member may be mounted below the cover.

The cover may have an inclination in a first direction, and the heat shielding member may have an inclination in a second direction opposite to the first direction, to generate natural convection in the external air circulation chamber.

The at least one external air flow hole may be provided at a position proximate to a higher end of the cover, and the heat shielding member may be mounted such that a portion opposite to the at least one external air flow hole is disposed adjacent to an inner surface of the cover.

The heat shielding member may include a depressed portion depressed downward and having the inclination in the second direction.

The cover may include at least one internal air exhaust hole to exhaust air rising along a lower surface of the heat shielding member. The at least one internal air exhaust hole may be provided at a position opposite to the at least one external air flow hole.

The cover and the heat shielding member may have inclinations in directions opposite to each other with respect to a horizontal plane.

The image forming apparatus may further include a paper guide member mounted between the heat shielding member and the fusing unit to guide paper which has passed by the fusing unit to the paper discharge part of the main body.

The foregoing and/or other aspects are achieved by providing an image forming apparatus, including: a main body; a fusing unit mounted in the main body; a cover mounted to the main body to expose the fusing unit to fuse an image to paper; a heat shielding member mounted below the cover to block heat transferred from the fusing unit, the heat shielding member including an inclined surface having an inclination with respect to a horizontal plane; and at least one internal air exhaust hole to exhaust air rising along the inclined surface of the heat shielding member.

The foregoing and/or other aspects are achieved by providing an image forming apparatus, including: a main body; a fusing unit mounted in the main body; a cover mounted to the main body; a heat shielding member mounted adjacent to an inner surface of the cover and having an inclined surface inclined downward with respect to the cover.

An external air circulation chamber may be defined between the heat shielding member and the cover.

At least one external air flow hole may be defined between a first end of the heating shielding member and the inner surface of the cover through which air flows into/out of the external air circulation chamber.

At least one internal air flow hole may be defined between a second end of the heating shielding member and the inner surface of the cover to exhaust air rising along the inclined surface of the heat shielding member.

The cover may be inclined in a first direction and the inclined surface of the heat shielding member may be inclined in a second direction opposite the first direction.

BRIEF DESCRIPTION OF THE DRAWINGS

These and/or other aspects and advantages will become apparent and more readily appreciated from the following description of the embodiment, taken in conjunction with the accompanying drawings, of which.

DETAILED DESCRIPTION OF THE EMBODIMENTS

Figure 1:
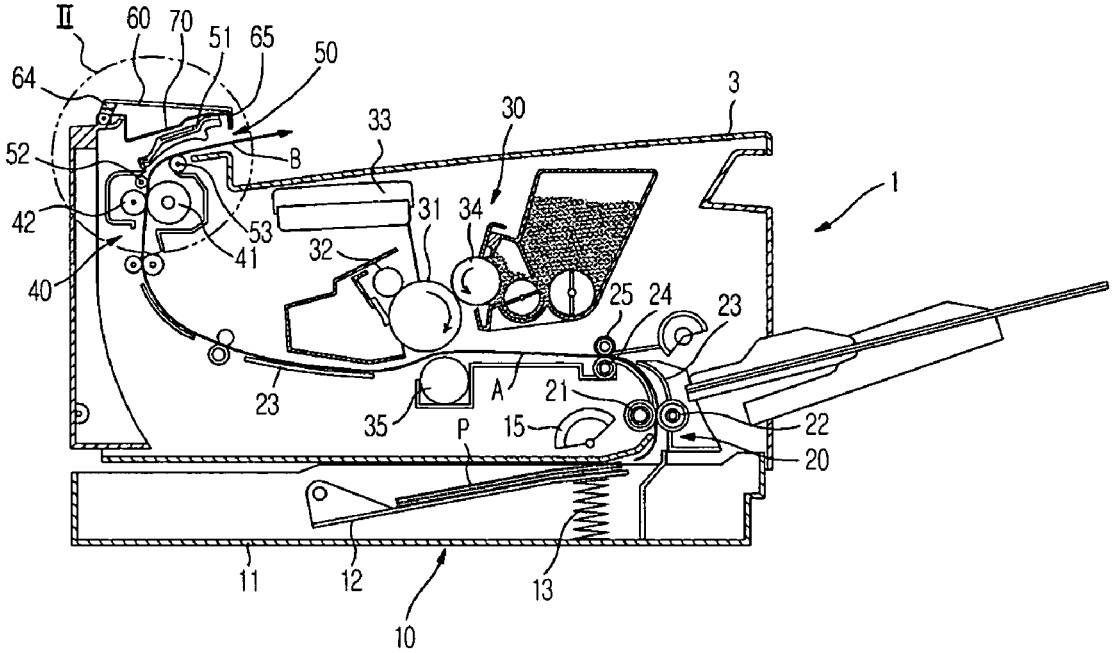
FIG. 1 is a sectional view illustrating a schematic constitution of an image forming apparatus in accordance with a present embodiment.

Reference will now be made in detail to an embodiment, examples of which are illustrated in the accompanying drawings, wherein like reference numerals refer to like elements throughout. The embodiment is described below to explain the present invention by referring to the figures.

FIG. 1 shows a schematic constitution of an image forming apparatus in accordance with the present embodiment. An image forming apparatus includes a paper supply unit 10 to load paper P thereon, a feed unit 20 to feed the paper P, an image forming unit 30 to form an image on the paper P, a fusing unit 40 to fuse a transferred image to the paper P, and a paper discharge unit 50 to discharge the paper P.

The paper supply unit 10 is mounted in a lower portion of a main body 1. The paper supply unit 10 includes a cassette-type paper tray 11, a press plate 12 and a press spring 13, which press the paper P in the paper tray 11 to a pickup roller 15 disposed above the press plate 12. The press spring 13 is mounted under the press plate 12, and biases the press plate 12 toward the pickup roller 15. The pickup roller 15 picks up the paper sheet by sheet by the rotation, and supplies the paper to the feed unit 20.

The feed unit 20 feeds the paper picked up by the pickup roller 15 to a print path A. The feed unit 20 includes a feed roller 21, a feed backup roller 22, a feed guide 23 which forms the print path A, a register roller 24 and a register backup roller 25, which register a front end of the fed paper.

The image forming unit 30 includes a photosensitive roller 31 positioned in the print path A, a charge roller 32 which charges the photosensitive roller 31, a laser scanning unit (LSU) 33 which irradiates a laser beam to the charged photosensitive roller 31 according to an image signal to form an electrostatic latent image on the surface of the photosensitive roller 31, a developing roller 34 which supplies a developer to the electrostatic latent image formed on the photosensitive roller 31 to form a visible image, and a transfer roller 35 which transfers the visible image formed on the photosensitive roller 31 onto the paper. The photosensitive roller 31 charged by the charge roller 32 has a negative charge, and the electrostatic latent image is formed on the surface of the photosensitive roller 31 by the laser beam irradiated from the LSU 33. The developing roller 34 supplies the developer having a negative charge to the electrostatic latent image on the photosensitive roller 31 to form the visible image. The transfer roller 35 having a positive charge transfers the developer adhering to the photosensitive roller 31 onto the paper.

The fusing unit 40 is disposed near an outlet of the print path A. The fusing unit 40 includes a heat roller 41 and a press roller 42. While the paper passes between the heat roller 41 and the press roller 42, the fusing unit 40 applies heat and pressure to the developer (image) transferred onto the paper so that the developer is fused onto the paper.

Figure 2:
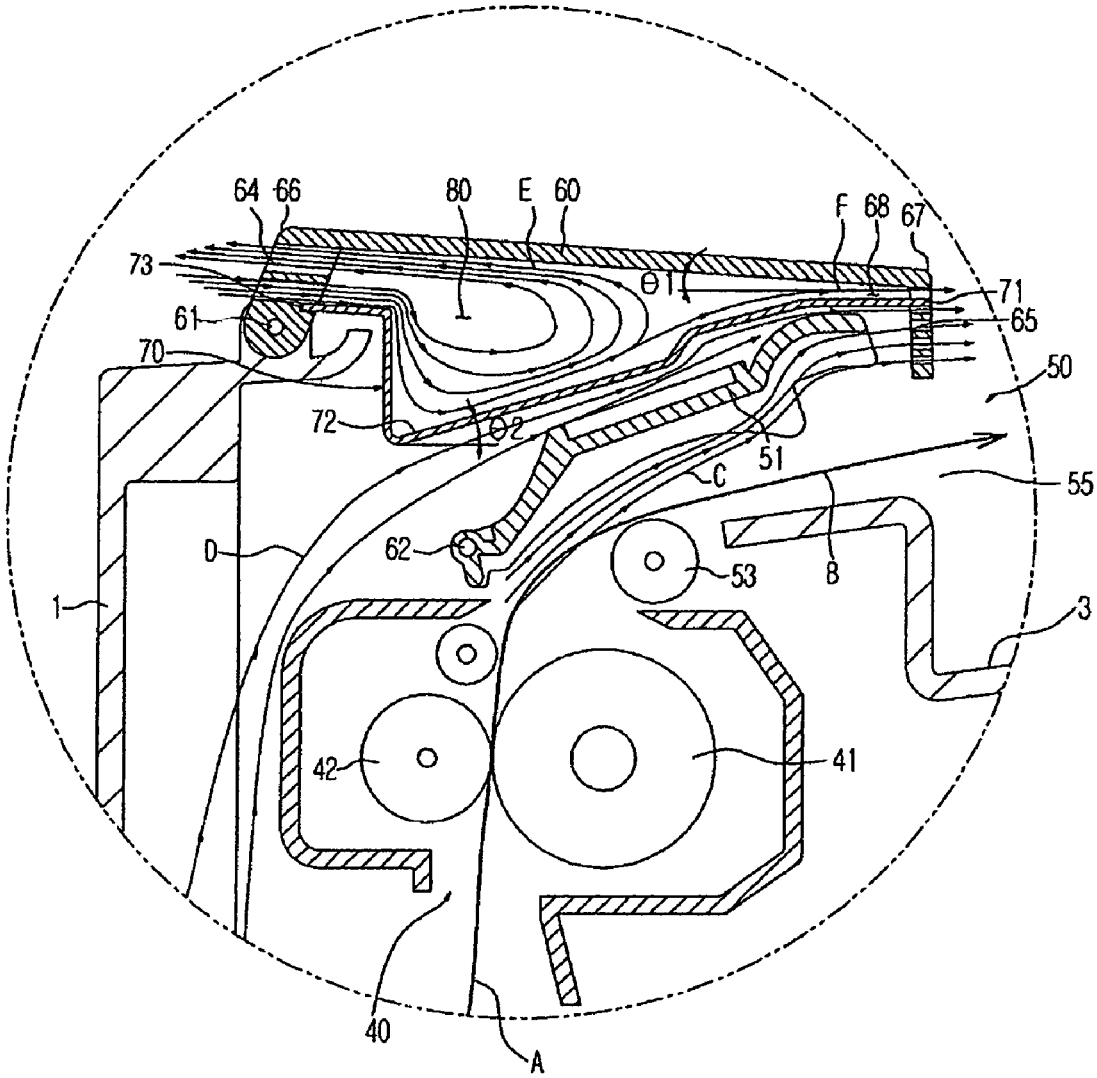
FIG. 2 is a detailed view of the II portion in FIG. 1.

The paper discharge unit 50 feeds the paper, which has passed through the fusing unit 40, to a paper discharge part 3 provided on an upper portion of the main body 1. As shown in FIG. 2, the paper discharge unit 50 includes a paper guide member 51 which is mounted above the fusing unit 40 and guides the paper to the paper discharge part 3, and plural discharge rollers 52 and 53 which are disposed in a discharge path B.

Figure 3:
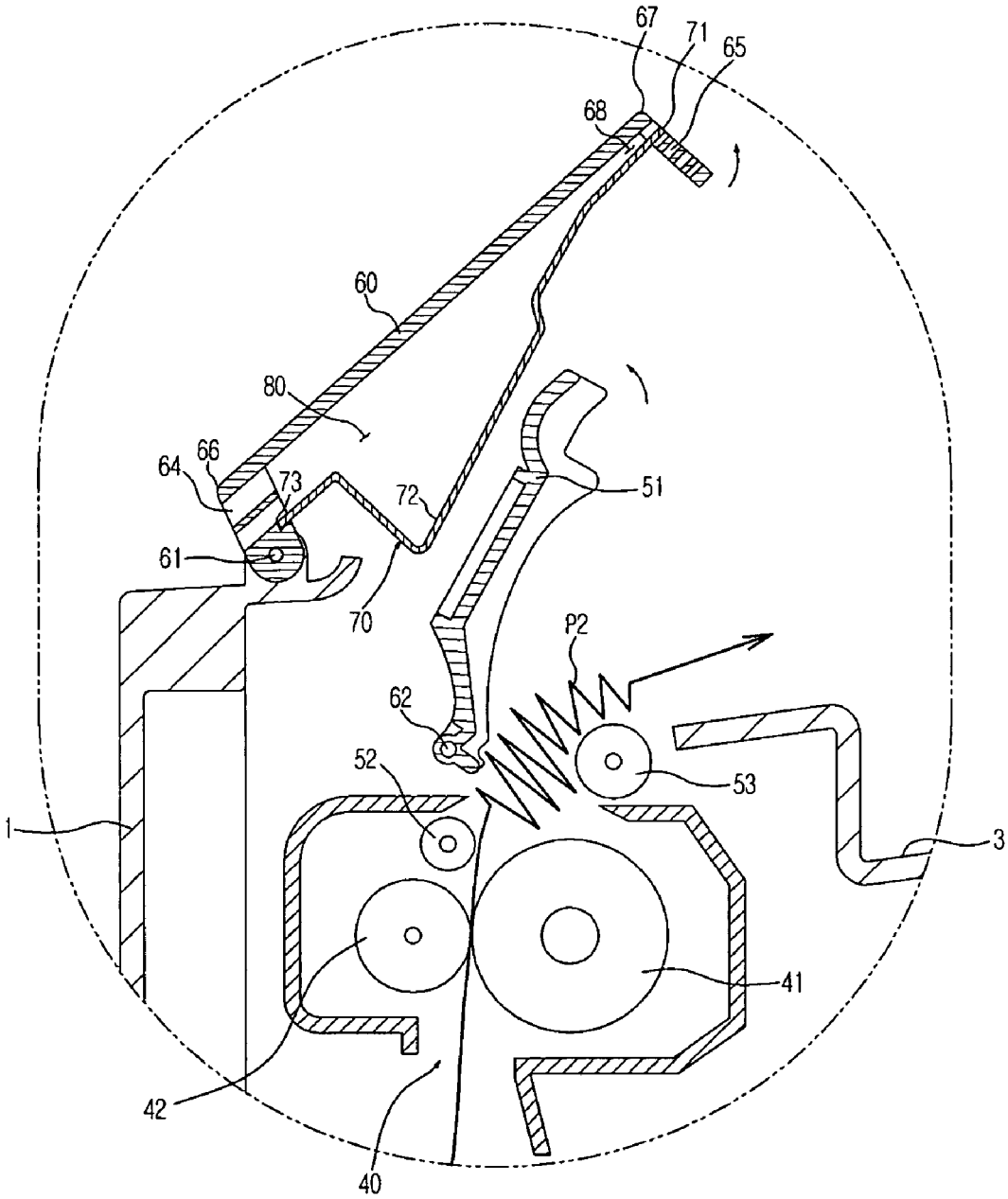
FIG. 3 is a sectional view illustrating an opened state of a cover and a paper guide member depicted in FIG. 1.

A cover 60 is provided on the upper portion of the main body 1 so that the fusing unit 40 and the discharge path B can be exposed to the outside. Because the paper discharged toward the paper discharge part 3 via the fusing unit 40 becomes pliable by being heated by the fusing unit 40, the paper may be easily jammed in the discharge path B in a downstream side of the fusing unit 40. As shown in FIG. 3, the jammed paper P2 can be easily removed by opening the cover 60. The cover 60 is rotatably coupled to the upper portion of the main body 1 by a first hinge shaft 61 so as to be opened and closed by rotating upward and downward. The paper guide member 51 is rotatably mounted by a second hinge shaft 62.

As shown in FIG. 2, a heat shielding member 70 is mounted below the cover 60 (near an inner side of the cover 60) to block the heat transferred to the cover 60 from the fusing unit 40, thereby minimizing a temperature rise of the cover 60. The heat shielding member 70 is spaced apart from an inner surface of the cover 60 to form an external air circulation chamber 80 so that the external air circulates between the cover 60 and the heat shielding member 70. External air flow holes 64 are formed at a rear end of the cover 60, through which the external air flows into/out of the external air circulation chamber 80.

Based on a closed state of the cover 60, the cover 60 has an inclination of a predetermined angle θ1 in a first direction, by which the rear end of the cover 60 is directed upward. The heat shielding member 70 has an inclination of a predetermined angle θ2 in a second direction which is opposite to the first direction. In other words, the heat shielding member 70 has the inclination by which a front end 71 of the heat shielding member 70 adjacent to a paper discharge port 55 is directed upward. The front end 71 of the heat shielding member 70 is positioned near the inner surface of the cover 60 opposite to the external air flow holes 64. The heat shielding member 70 is provided with a depressed portion 72 which is depressed downward to expand a volume of the external air circulation chamber 80. The depressed portion 72 of the heat shielding member 70 has the inclination in the second direction. The external air flow holes 64 are provided at a higher end 66 (the rear end) of the cover 60. The external air flow holes 64 are defined by the rear end 66 of the cover 60 and a rear end 73 of the heat shielding member 70 spaced apart from the rear end 66 of the cover 60, and are formed lengthwise in a width direction of the cover 60. Since the cover 60 and the heat shielding member 70 are arranged such that the cover 60 and the heat shielding member 70 are inclined in the directions opposite to each other with respect to a horizontal plane, the external air can circulate in the external air circulation chamber 80 by natural convection and cool down the external air circulation chamber 80 and the heat shielding member 70. A more detailed explanation related to the above will be made later.

A front end 67 of the cover 60 (an opposite side to the external air flow holes 64) is provided with internal air exhaust holes 65 through which the air in the main body 1 is exhausted. The internal air exhaust holes 65 are unitarily formed at the cover 60, and are formed lengthwise in the width direction of the cover 60. The air rising from the interior of the main body 1 by the heat of the fusing unit 40 (air rising by convection) rises along the lower surface of the inclined heat shielding member 70, and then is exhausted through the internal air exhaust holes 65.

Hereinafter, a cooling principle of the cover 60 and the heat shielding member 70 will be explained.

As shown in FIG. 2, when the image forming apparatus operates, the heat roller 41 of the fusing unit 40 is kept in a temperature of about 160° C. to 200° C. So, the air C and D around the fusing unit 40 is heated by the fusing unit 40, and the heated air rises by convection. The heated air C and D rises along the inclined lower surface of the heat shielding member 70, and is exhausted through the internal air exhaust holes 65.

Because the air C and D rising from the fusing unit comes into contact with the lower surface of the heat shielding member 70, but does not contact the cover 60, the air C and D does not directly increase the temperature of the cover 60. Also, since the air C and D is guided smoothly toward the internal air exhaust holes 65 by the inclined lower surface of the heat shielding member 70, the air C and D is exhausted promptly through the internal air exhaust holes 65. Such an air flow causes the smooth circulation of the internal air of the main body 1, and accordingly the heat that stays in the main body 1 can be minimized. As a result, the heat transfer from the fusing unit 40 to the heat shielding member 70 can also be minimized.

The heat shielding member 70 may be heated by the rising air C and D. However, because the external air circulation chamber 80 formed between the heat shielding member 70 and the cover 60 functions as a heat insulating layer (an air heat insulating layer), the heat transfer from the heat shielding member 70 to the cover 60 can be minimized. Moreover, because the external air circulates in the external air circulation chamber 80 by natural convection, the heat shielding member 70 can be cooled down. The air circulation in the external air circulation chamber 80 is achieved as follows.

The air E in the external air circulation chamber 80 is heated by the heat of the heat shielding member 70, and its temperature rises. The heated air E is guided to the rear end 66 of the cover 60 along the inclined lower surface of the cover 60, and then is exhausted through the upper external air flow hole of the external air flow holes 64. In other words, the cover 60 having the inclination guides the air E in the external air circulation chamber 80 to the external air flow holes 64. The equivalent amount of external air to the amount of exhausted air flows again into the external air circulation chamber 80 through the lower external air flow hole of the external air flow holes 64. Because the external air E circulating in the external air circulation chamber 80 by natural convection cools down the external air circulation chamber 80 and the heat shielding member 70, the heat transfer from the heat shielding member 70 to the cover 60 can be minimized. In order to secure the smooth air circulation in the external air circulation chamber 80, it is preferable not to form an obstacle, such as a protrusion or a rib, to the air flow in the external air circulation chamber 80.

As shown in FIG. 2, a part of air F in the external air circulation chamber 80 can be exhausted forward through a gap 68 formed between the front end 71 of the heat shielding member 70 and the front end 67 of the cover 60. Accordingly, the heat can be prevented from being directly conducted to the cover 60 from the heat shielding member 70.

Figure 4:
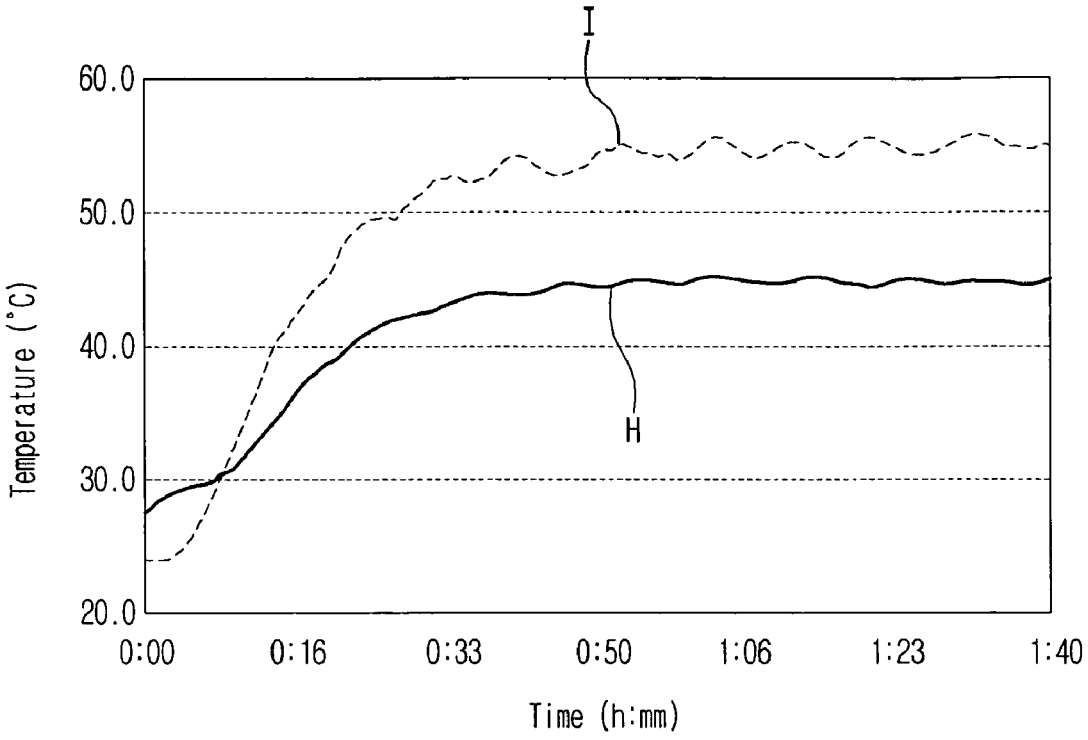
FIG. 4 is a graph showing a temperature change of the cover of the image forming apparatus having a heat shielding member in accordance with the present embodiment.

FIG. 4 is a graph showing a temperature change of the cover of the image forming apparatus having the heat shielding member according to the present embodiment. A solid line H in FIG. 4 shows a temperature change of the cover 60 of the image forming apparatus having the heat shielding member 70 of the present embodiment, and a dashed line I shows a temperature change of the cover of the image forming apparatus without the heat shielding member 70. The heat roller 61 was kept in a temperature of about 180° C. to 200° C.

As shown in FIG. 4, the temperature of the cover 60 without the heat shielding member 70 was kept in an average temperature of 55° C., and the temperature of the cover 60 with the heat shielding member 70 of this embodiment was kept in an average temperature of 45° C. According to the experimental result, the image forming apparatus having the heat shielding member 70 can drop the temperature of the cover 60 by about 10° C., when compared to the apparatus without the heat shielding member.

As apparent from the above description, the image forming apparatus according to the present embodiment can minimize the temperature rise of the cover, because the heat shielding member mounted near the inner side of the cover can block the heat transferred from the fusing unit, and the external air circulating in the external air circulation chamber formed between the cover and the heat shielding member by natural convection cools down the external air circulation chamber and the heat shielding member.

Further, since the internal air rising from the interior of the main body by convection is guided along the inclined lower surface of the heat shielding member and is promptly exhausted through the internal air exhaust holes, the heat can be prevented from staying in the main body, especially at the area above the fusing unit. Accordingly, the temperature rise of the cover can be minimized.

Although an embodiment has been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising:

a main body having a paper discharge part to discharge paper;

a fusing unit mounted in the main body to fuse an image to the paper;

a cover mounted to the main body to expose the fusing unit;

a heat shielding member mounted proximate to an inner side of the cover to block heat transferred from the fusing unit;

an external air circulation chamber formed between the heat shielding member and the cover as an empty space, in which external air circulates by convection; and at least one external air flow hole through which the air flows into/out of the external air circulation chamber and provided at a position proximate to a higher end of the cover, wherein the external air flow hole comprises, an upper external air flow hole through which the air flows out of the external air circulation chamber; a lower external air flow hole through which the air flows into the external air circulation chamber and positioned below the upper external air flow hole; and the heat shielding member is disposed to be inclined upwardly toward an end of the cover opposite of the higher end, and at least one internal air exhaust hole is provided at the end of the cover opposite of the higher end so that air in the main body rises along the inclination of the heat shielding member and is exhausted outside through the at least one internal air exhaust hole.

2. The image forming apparatus according to claim 1, wherein the cover is mounted on an upper portion of the main body to expose or shield the fusing unit, and the heat shielding member is mounted below the cover.

3. The image forming apparatus according to claim 1, wherein the cover has an inclination in a first direction, and the heat shielding member has an inclination in a second direction opposite to the first direction, to generate natural convection in the external air circulation chamber.

4. The image forming apparatus according to claim 1, wherein the heat shielding member is mounted such that a portion opposite to the at least one external air flow hole is disposed adjacent to an inner surface of the cover.

5. The image forming apparatus according to claim 3, wherein the heat shielding member includes a depressed portion depressed downward and having the inclination in the second direction.

6. The image forming apparatus according to claim 1, wherein the cover and the heat shielding member have inclinations in directions opposite to each other with respect to a horizontal plane.

7. The image forming apparatus according to claim 1, further comprising:

a paper guide member mounted between the heat shielding member and the fusing unit to guide paper which has passed by the fusing unit to the paper discharge part of the main body.

8. An image forming apparatus, comprising:

a main body;

a fusing unit mounted in the main body;

a cover mounted to the main body;

a heat shielding member mounted adjacent to an inner surface of the cover and having an inclined surface inclined downward with respect to the cover, an external air circulation chamber formed between the heat shielding member and the cover as a empty space, in which external air circulates by convection; and at least one external air flow hole defined between a first end of the heating shielding member and the inner surface of the cover through which the air flows into/out of the external air circulation chamber and provided at a position proximate to a higher end of the cover, wherein the external air flow hole comprises, an upper external air flow hole through which the air flows out of the external air circulation chamber;

a lower external air flow hole through which the air flows into the external air circulation chamber and positioned below the upper external air flow hole; and the heat shielding member is disposed to be inclined upwardly toward an end of the cover opposite of the higher end, and at least one internal air exhaust hole is provided at the end of the cover opposite of the higher end so that air in the main body rises along the inclination of the heat shielding member and is exhausted outside through the at least one internal air exhaust hole.

9. The image forming apparatus according to claim 8, wherein the cover is inclined in a first direction and the inclined surface of the heat shielding member is inclined in a second direction opposite the first direction.

* * * * *

UNITED STATES PATENT AND TRADEMARK OFFICE

CERTIFICATE OF CORRECTION

PATENT NO. : 8,200,115 B2
APPLICATION NO. : 12/081951
DATED : June 12, 2012
INVENTOR(S) : Gyu Deok Hwang et al.

It is certified that error appears in the above-identified patent and that said Letters Patent is hereby corrected as shown below:

Title Page item [75] (Inventors), Delete "Sung-Hyuo Kim" and insert -- Sung Hyup Kim --, therefor.

Signed and Sealed this
Fourteenth Day of August, 2012

David J. Kappos

David J. Kappos
*Director of the United States Patent and Trademark Office*